US008532512B2

(12) United States Patent
Yoshimoto

(10) Patent No.: US 8,532,512 B2
(45) Date of Patent: Sep. 10, 2013

(54) IMAGE FORMING APPARATUS

(75) Inventor: Tetsuhiro Yoshimoto, Kashiwa (JP)

(73) Assignee: Canon Kabushiki Kaisha (JP)

( * ) Notice: Subject to any disclaimer, the term of this patent is extended or adjusted under 35 U.S.C. 154(b) by 342 days.

(21) Appl. No.: 12/862,516

(22) Filed: Aug. 24, 2010

(65) Prior Publication Data

US 2011/0058833 A1 Mar. 10, 2011

(30) Foreign Application Priority Data

Sep. 9, 2009 (JP) ..... 2009-208012

(51) Int. Cl.
*G03G 15/02* (2006.01)

(52) U.S. Cl.
USPC ..... 399/50

(58) Field of Classification Search
USPC ..... 399/46, 50, 53, 89
See application file for complete search history.

(56) References Cited

U.S. PATENT DOCUMENTS 5,444,519 A * 8/1995 Motoyama et al. ..... 399/50

FOREIGN PATENT DOCUMENTS

JP 5-011571 A 1/1993
JP 9-101656 A 4/1997

* cited by examiner

*Primary Examiner* — David Gray
*Assistant Examiner* — Gregory H Curran
(74) *Attorney, Agent, or Firm* — Rossi, Kimms & McDowell LLP

(57) ABSTRACT

An image forming apparatus includes: a charging unit which charges a surface of an image bearing member by contacting the image bearing member with a charging member to which a charging bias is applied, the charging bias being a voltage obtained by superimposing an AC voltage on a DC voltage; an electrostatic latent image forming unit which forms an electrostatic latent image on the surface of the image bearing member which is charged by the charging unit; a developing unit which develops the electrostatic latent image by using a developing bias formed by the voltage obtained by superimposing the AC voltage on the DC voltage; and a control unit which performs changing control of an AC frequency of the charging bias while maintaining a frequency ratio of an AC frequency of the developing bias to be an integral multiple of the AC frequency of the charging bias.

3 Claims, 5 Drawing Sheets

IMAGE FORMING APPARATUS

BACKGROUND OF THE INVENTION

1. Field of the Invention

The present invention relates to an image forming apparatus using an electrophotography technology, such as a copying machine or a laser beam printer, and more particularly, to a control method for image formation including a step of charging a surface of the image bearing member as a member to be charged.

2. Description of the Related Art

In the image forming apparatus or the like using the electrophotography technology, a contact type charger is used, in which a voltage is applied to a charging member, and the charging member is brought into contact with the surface of the member to be charged for charging.

The contact charger is categorized into a direct current (DC) charging type and an alternative current (AC) charging type. In the DC charging type, only a DC voltage Vdc is applied as a charging bias to the charging member to charge the member to be charged. In the AC charging type, an AC voltage Vac is superimposed on the DC voltage Vdc that is applied to the charging member to charge the member to be charged. The AC charging type is more effective than the DC charging type in charging uniformly because the AC component suppresses a variation of the charging voltage. Therefore, the AC charging type is more common in recent years.

The AC charging type applies the AC voltage having a sine wave to the charging member. Therefore, the charger vibrates physically at a frequency of the sine wave, which causes vibration sound. The AC charging type applies the AC voltage having a frequency of approximately 1 kilohertz (KHz), which is within the audible frequency range for human being. Therefore, there is a problem that human being finds the generated sound uncomfortable, that is, a problem of so-called charging sound. For instance, Japanese Patent Application Laid-Open No. H05-011571 proposes a solution for this problem.

There is a problem that interference fringes appear in a visualized image after developing because of a difference between an AC frequency of the charging bias (hereinafter, referred to as a charging bias frequency) and an AC frequency of a developing bias that is applied to a developer carrier of a developing device (hereinafter, referred to as a developing bias frequency). This problem is described in Japanese Patent Application Laid-Open No. H09-101656.

In the method described in Japanese Patent Application Laid-Open No. H05-011571, the charging bias frequency is set to a lower value depending on a type of the image. Thus, the frequency of the generated charging sound is lowered to be a frequency in the range to which human sense of hearing is not sensitive, so that intensity of the generated sound is reduced.

In the method of changing the charging bias frequency according to a type of the image, the charging bias frequency can be changed when forming an image pattern causing no interference fringes, as in the case of a character pattern. However, as for an image that is apt to generate interference fringes, the charging bias frequency cannot be changed. Therefore, generation of the charging sound cannot be suppressed. Even if the charging bias frequency is changed, the frequency is constant during the image formation. Therefore, the charging sound has a constant peak frequency. In contrast, there is considered a method of reducing uncomfortable peak sound by changing the charging bias frequency within a constant range even during the image formation to realize spread spectrum of the charging sound. However, this method may generate interference fringes with respect to a formed image because of interference between the developing bias frequency applied to the developing device and the charging bias frequency applied to the charging member as described in Japanese Patent Application Laid-Open No. H09-101656.

SUMMARY OF THE INVENTION

The present invention provides an image forming apparatus that prevents generation of interference fringes and reduces charging sound by changing the charging bias frequency while maintaining a frequency ratio between the developing bias frequency and the charging bias frequency during formation of one image.

An image forming apparatus according to the present invention includes: a charging unit which charges a surface of an image bearing member by contacting the image bearing member with a charging member to which a charging bias is applied, the charging bias being a voltage obtained by superimposing an alternative current (AC) voltage on a direct current (DC) voltage; an electrostatic latent image forming unit which forms an electrostatic latent image on the surface of the image bearing member which is charged by the charging unit; a developing unit which develops the electrostatic latent image by using a developing bias formed by the voltage obtained by superimposing the AC voltage on the DC voltage; and a control unit which performs changing control of an AC frequency of the charging bias while maintaining a frequency ratio of an AC frequency of the developing bias to be an integral multiple of the AC frequency of the charging bias.

Further features of the present invention will become apparent from the following description of exemplary embodiments with reference to the attached drawings.

DESCRIPTION OF THE EMBODIMENT

Hereinafter, an embodiment mode of the present invention is described in detail with reference to an embodiment of an image forming apparatus.

First Embodiment

Figure 2:
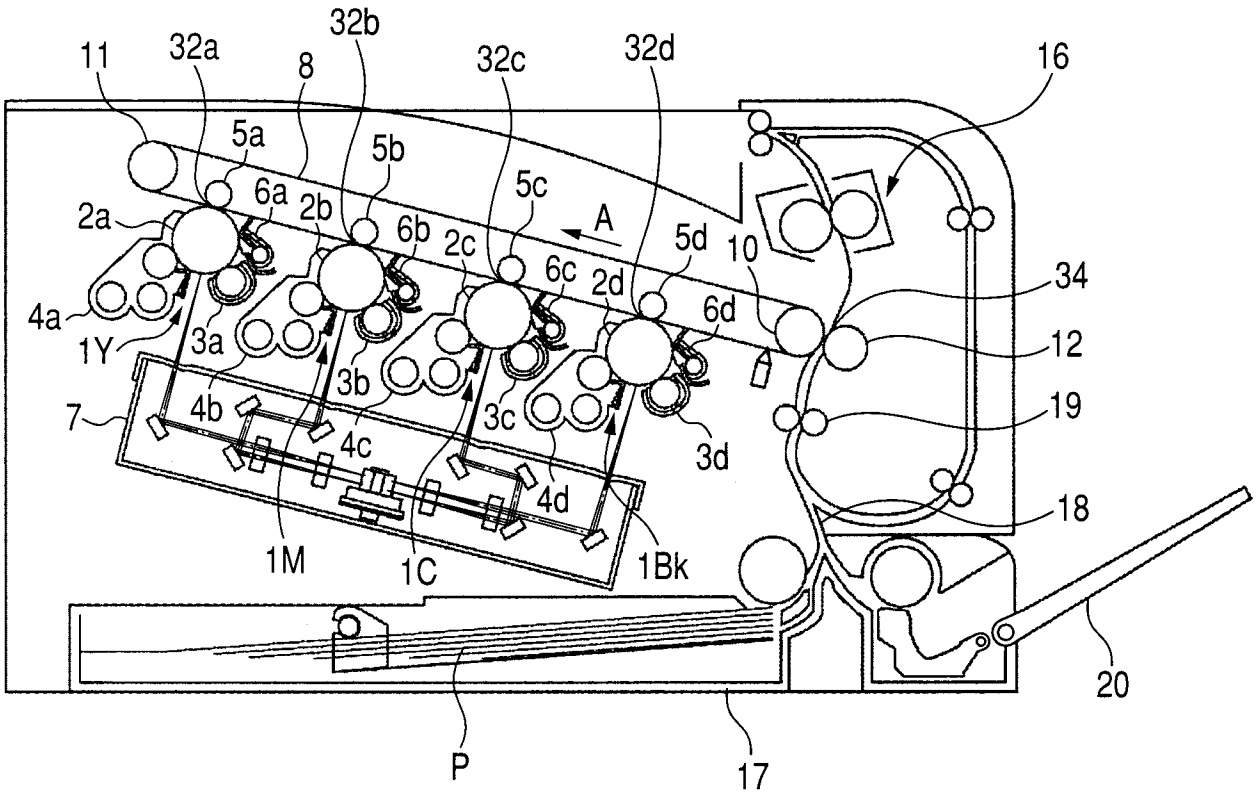
FIG. 2 illustrates a general structure of a color image forming apparatus according to the first embodiment.

FIG. 2 is a cross sectional view illustrating a general structure of a color image forming apparatus according to a first embodiment of the present invention. The apparatus is a tandem type color image forming apparatus (color printer) including an intermediate transferring belt, which is an example of an electrophotographic color image forming apparatus as illustrated in the figure. Hereinafter, with reference to FIG. 2, a structure and an operation of an image forming unit of the electrophotographic color image forming apparatus are described.

The image forming apparatus has four image forming units including an image forming unit 1Y which forms a yellow color image, an image forming unit 1M which forms a magenta color image, an image forming unit 1C which forms a cyan color image, and an image forming unit 1Bk which forms a black color image. The four image forming units 1Y, 1M, 1C, and 1Bk are arranged in line with a constant pitch. Below the image forming units 1Y, 1M, 1C, and 1Bk, there are disposed paper feed units 17 and 20. Convey paths 18 and 19 for recording media are arranged vertically, and a fixing unit 16 is disposed above the convey paths 18 and 19.

An operation of the image forming unit is described in detail. Each of the image forming units 1Y, 1M, 1C, and 1Bk is provided with a drum type electrophotographic photosensitive member (hereinafter, referred to as a photosensitive drum) 2*a*, 2*b*, 2*c*, or 2*d* as an image bearing member. Around each of the photosensitive drums 2*a*, 2*b*, 2*c*, and 2*d*, there are arranged a primary charger 3*a*, 3*b*, 3*c*, or 3*d*, a developing device 4*a*, 4*b*, 4*c*, or 4*d*, a transferring roller 5*a*, 5*b*, 5*c*, or 5*d* as a transferring unit, and a drum cleaner device 6*a*, 6*b*, 6*c*, or 6*d*. Below the primary chargers 3*a*, 3*b*, 3*c*, and 3*d* and the developing devices 4*a*, 4*b*, 4*c*, and 4*d*, there is disposed a laser exposure device 7 that is an electrostatic latent image forming unit.

Each of the photosensitive drums 2*a*, 2*b*, 2*c*, and 2*d* is a negatively charged organic photoconductor (OPC) photosensitive member including a photoconductive layer formed on a drum base made of aluminum, which is driven to rotate at a predetermined process speed in a clockwise direction by a drive unit (not shown). The primary chargers 3*a*, 3*b*, 3*c*, and 3*d* as primary charging units are contact charging type chargers. The primary charger brings a charging member applied with a charging bias from a charging bias power supply (not shown) into contact with each of the photosensitive drums 2*a*, 2*b*, 2*c*, and 2*d*, so that each surface of the photosensitive drums 2*a*, 2*b*, 2*c*, and 2*d* is charged uniformly at a predetermined potential of negative polarity.

The laser exposure device 7 disposed below the photosensitive drums includes a laser emitter which emits light corresponding to a given electric digital pixel signal of image information in time sequence, a polygon lens, a reflection mirror, and the like. When each of the photosensitive drums 2*a*, 2*b*, 2*c*, and 2*d* is exposed, an electrostatic latent image of each color corresponding to the image information is formed on a surface of each of the photosensitive drums 2*a*, 2*b*, 2*c*, and 2*d* which are charged by primary chargers 3*a*, 3*b*, 3*c*, and 3*d*, respectively. The developing devices 4*a*, 4*b*, 4*c*, and 4*d* contain yellow toner, magenta toner, cyan toner, and black toner, respectively. Toner of each color adheres to each of the electrostatic latent images formed on the photosensitive drums 2*a*, 2*b*, 2*c*, and 2*d*, so that the image is developed (visualized) as a toner image.

The transferring rollers 5*a*, 5*b*, 5*c*, and 5*d* as primary transferring units are disposed so as to be pressed against the photosensitive drums 2*a*, 2*b*, 2*c*, and 2*d* via an intermediate transferring belt 8 at primary transferring portions 32*a*, 32*b*, 32*c*, and 32*d*, respectively. The toner images on the photosensitive drums 2*a*, 2*b*, 2*c*, and 2*d* are sequentially transferred and superimposed on the intermediate transferring belt 8, so that the toner images are transferred. Each of drum cleaner devices 6*a*, 6*b*, 6*c*, and 6*d* is constituted of a cleaning blade or the like, and scrapes transfer residual toner on each of the photosensitive drums 2*a*, 2*b*, 2*c*, and 2*d* remaining in the primary transferring off the photosensitive drums 2*a*, 2*b*, 2*c*, and 2*d*, so that the surface of the photosensitive drum is cleaned.

The intermediate transferring belt 8 is disposed on the upper surface side of the photosensitive drums 2*a*, 2*b*, 2*c*, and 2*d*, and loops around a secondary transfer opposing roller 10 and a tension roller 11. The secondary transfer opposing roller 10 is disposed so as to be pressed against a secondary transferring roller 12 via the intermediate transferring belt 8 at a secondary transferring portion 34. The intermediate transferring belt 8 is made of a dielectric resin such as polycarbonate, polyethylene terephthalate resin film, polyvinylidene fluoride resin film, or the like. The image transferred onto the intermediate transferring belt 8 is then transferred onto the recording medium conveyed from the paper feed unit 17 at the secondary transferring portion 34. At the vicinity of the tension roller 11 outside the intermediate transferring belt 8, there is provided a belt cleaning device (not shown) for removing and collecting transfer residual toner remaining on the surface of the intermediate transferring belt 8. The image formation with toner of each color is performed by the process described above.

Figure 3:
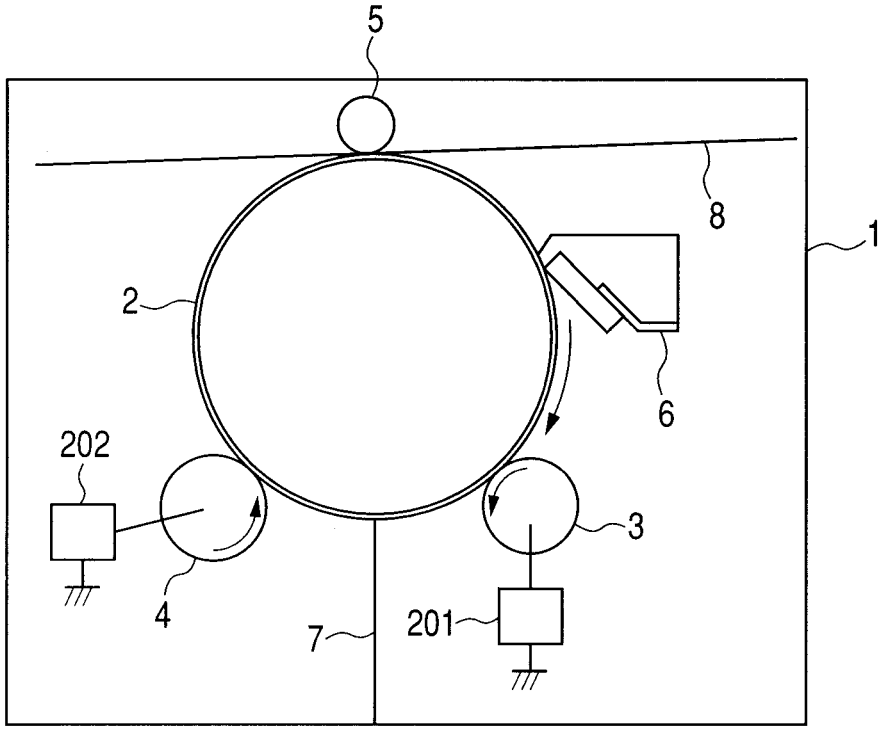
FIG. 3 illustrates a schematic cross sectional view of an image forming unit of the color image forming apparatus according to the first embodiment.

FIG. 3 is a cross sectional view of an image forming unit 1. FIG. 3 illustrates a photosensitive drum 2, a primary charger 3, a developing device 4, a transferring roller 5, a drum cleaner device 6, a laser beam 7 emitted from a laser exposure device (not shown), and the intermediate transferring belt 8. The primary charger 3 includes a charging bias power supply 201, and the developing device 4 includes a developing bias power supply 202.

Figure 4:
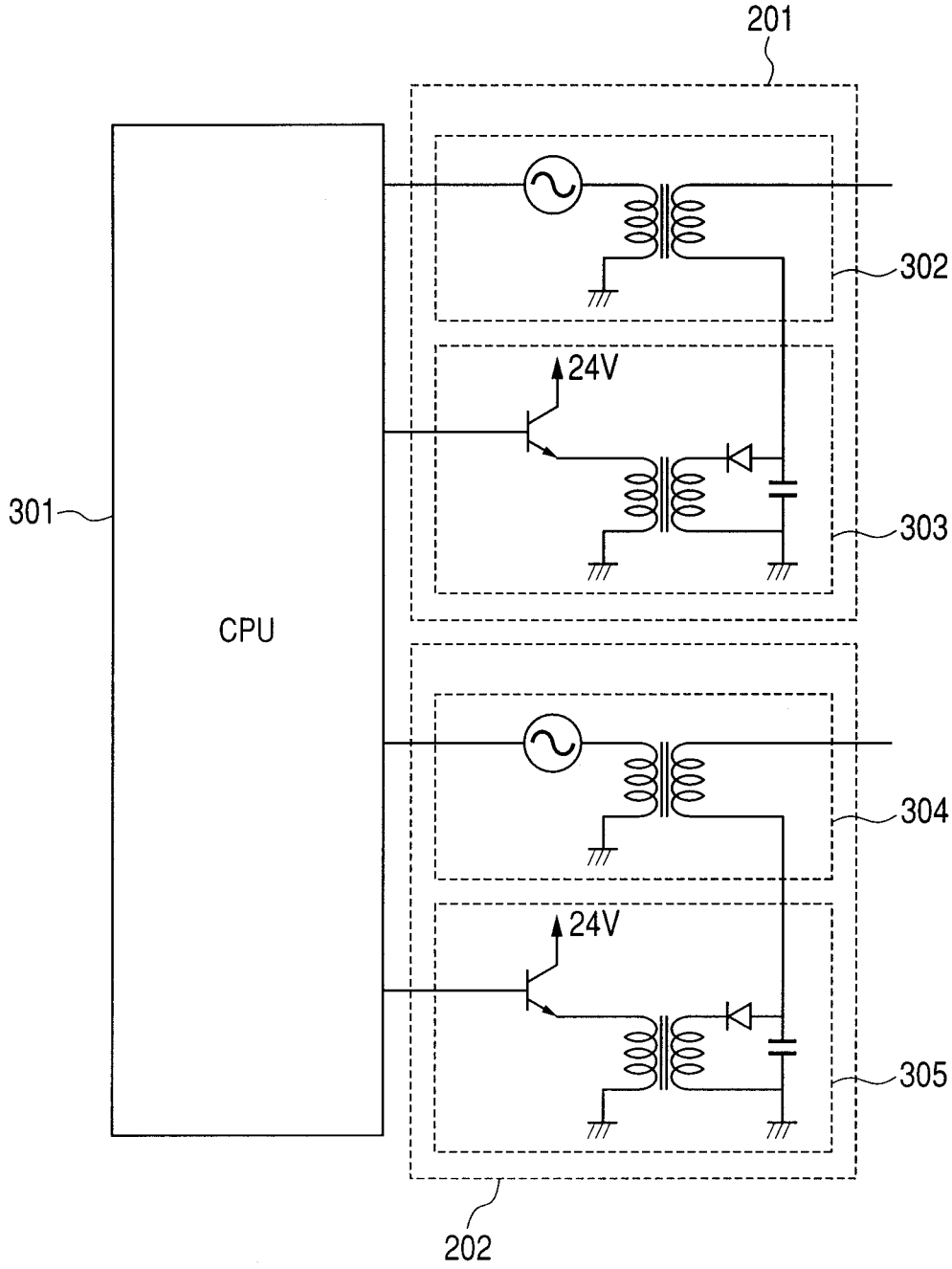
FIG. 4 illustrates a schematic diagram of a high voltage power supply circuit of the image forming unit according to the first embodiment.

Structures of the charging bias power supply 201 and the developing bias power supply 202, and control thereof are described with reference to a schematic diagram of a high voltage power supply circuit illustrated in FIG. 4.

The charging bias power supply 201 includes a charging alternative current (AC) unit 302 and charging direct current (DC) unit 303. An output voltage and an AC frequency of the charging bias power supply 201 are controlled by a central processing unit (CPU) 301. The CPU 301 sends a control signal of an AC output voltage and a sine wave for generating AC to the charging AC unit 302 during the image formation. The AC voltage in this case has a peak to peak voltage of approximately 1,800 volts (V). The AC frequency of the charging bias has a center frequency of approximately 1 KHz. The CPU 301 changes the frequency of the sine wave for generating AC, so that the frequency of the AC output voltage can be changed. In the charging AC unit 302, a DC component from the charging DC unit 303 is superimposed. The DC voltage in this case is approximately 800 V. As a result, an AC voltage having amplitude of ±800 V with respect to a DC voltage of −800 V is output from the charging AC unit 302.

Similarly to the charging bias power supply 201, the developing bias power supply 202 also includes a developing AC unit 304 and a developing DC unit 305. Control of the developing bias power supply 202 is the same as that of the charging bias power supply 201 except that a waveform of the AC voltage output from the developing AC unit 304 is a rectangular wave. An output from the developing bias power supply has amplitude of ±1,000 V with respect to a DC voltage of −1,000 V. An AC frequency of the developing bias is 10 kilohertz (KHz) that is ten times the AC frequency of the above-mentioned charging bias.

Figure 5:
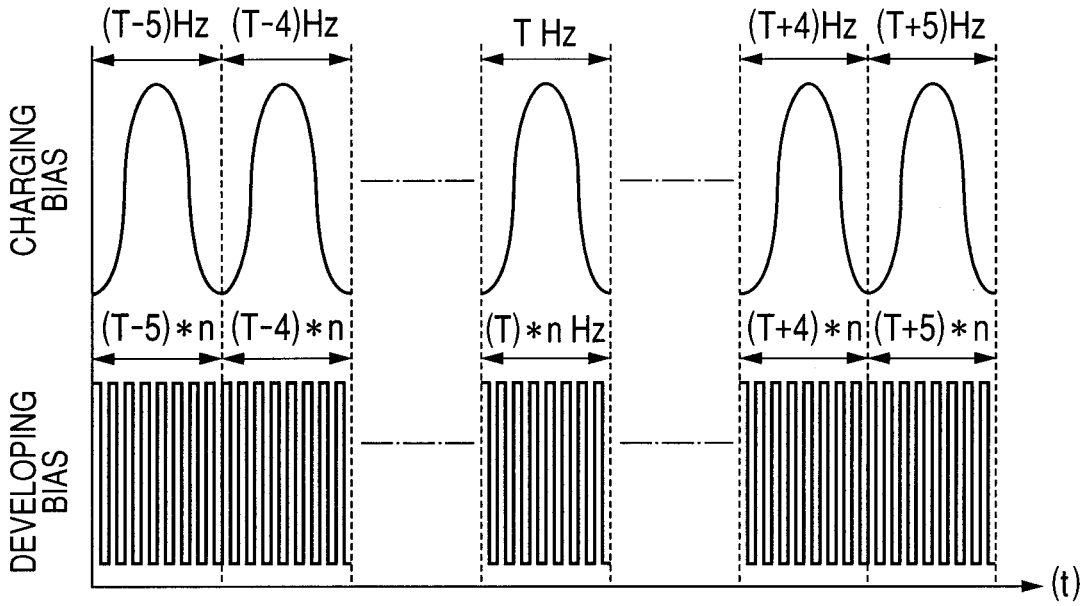
FIG. 5 illustrates a frequency change of a charging bias and a developing bias frequency according to the first embodiment.

Suppression of the charging sound by frequency change of the charging bias is described with reference to FIGS. 5 and 6. FIG. 5 illustrates time sequence waveforms of the charging bias and the developing bias when a center value of the charging bias frequency is T hertz (Hz), a range of the frequency change is ±5 Hz, the developing bias frequency is n times the charging bias frequency. The charging bias frequency is changed step by step at a constant time interval from (T−5) Hz to (T+5) Hz, and the developing bias frequency is also changed in synchronization with the charging bias frequency from ((T−5)×n) Hz to ((T+5)×n) Hz. The frequency is changed 200 times per second in this case, which is a rate that cannot be recognized by human being as sound.

Figure 6:
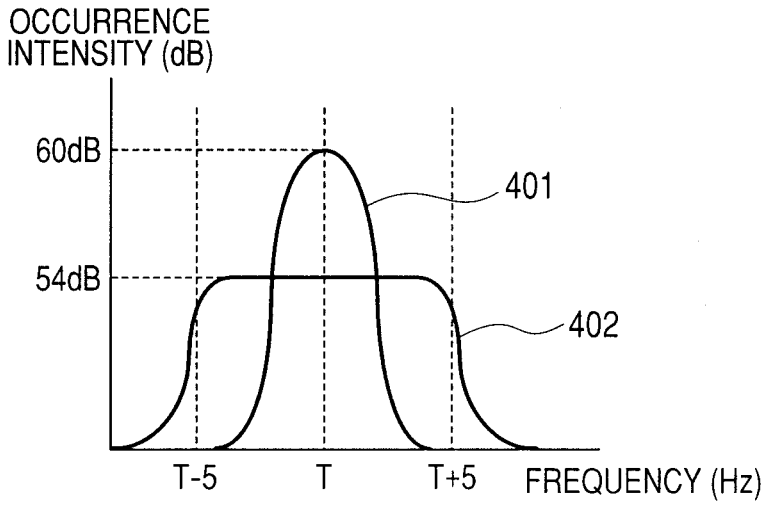
FIG. 6 illustrates a spectrum waveform of the charging bias according to the first embodiment.

FIG. 6 illustrates spectrum waveforms in the case where the charging bias frequency is a fixed frequency and in the case where the above-mentioned frequency change is performed. As illustrated in FIG. 6 as a waveform 401, the intensity peak of the generated charging sound is approximately 60 decibels (dB) in the case where a fixed frequency is used as the charging bias frequency. In contrast, as illustrated in FIG. 6 as a waveform 402, the intensity peak of the generated charging sound is reduced to approximately 54 dB by spectrum diffusion in the case where the charging bias frequency is changed. In this way, if the charging bias frequency is changed successively, the generation of the charging sound that is uncomfortable for human's sense of hearing may be suppressed.

Figure 1:
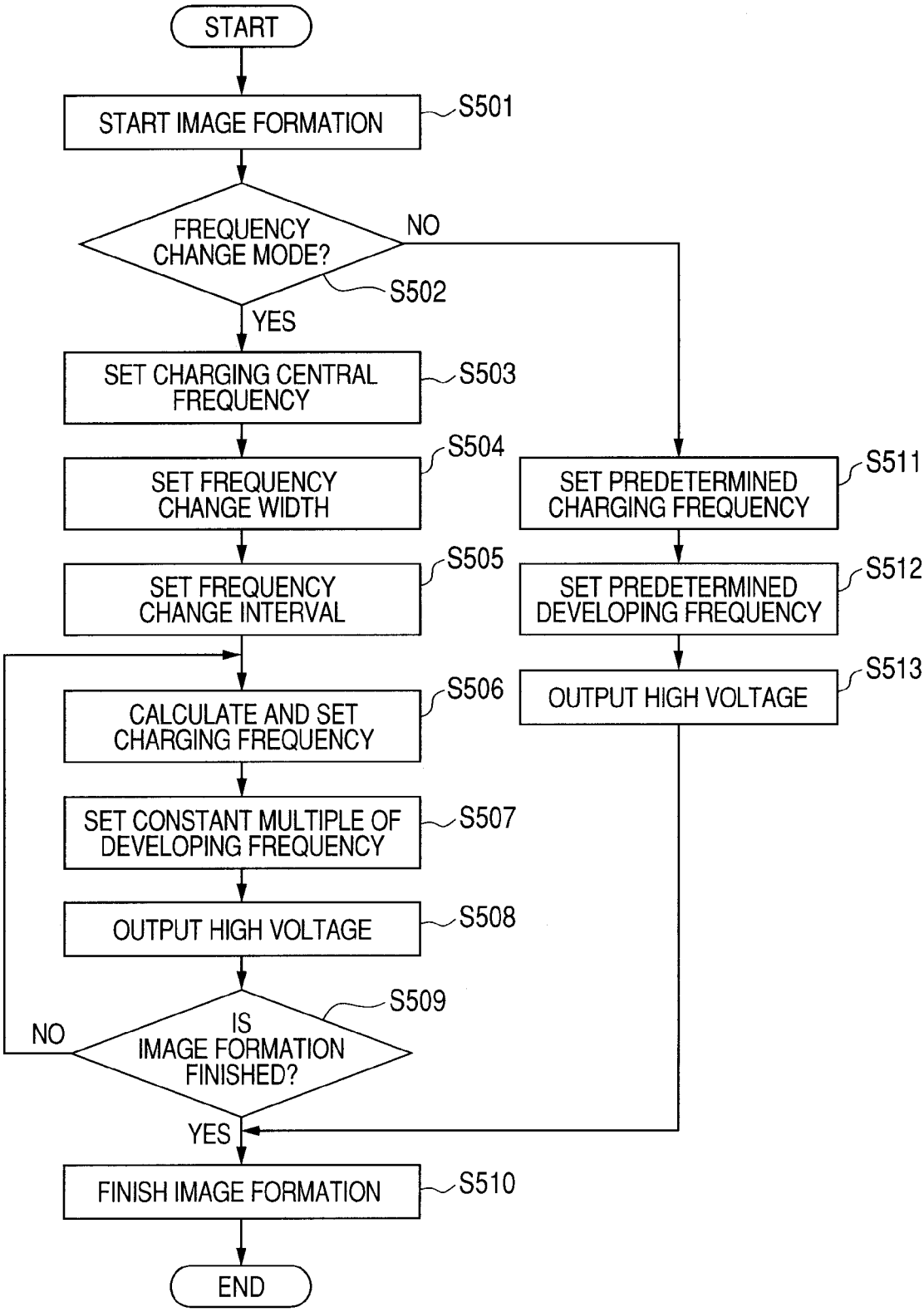
FIG. 1 illustrates a flowchart of frequency changing control according to a first embodiment of the present invention.

With reference to the flowchart of FIG. 1, control operation of the frequency change is described. This operation is performed by the CPU 301 illustrated in FIG. 4 according to a program stored in a read-only memory (ROM) (not shown).

When the image formation is started (S501), the CPU 301 decides whether or not the image forming apparatus is set to a frequency change mode in which the frequency changing control of the charging bias frequency and the developing bias frequency can be performed (S502). If the frequency change mode is not set, the CPU 301 sets a predetermined charging bias frequency (S511) and a predetermined developing bias frequency (S512), and the image forming apparatus starts to output a high voltage (S513).

If the image forming apparatus is set to the frequency change mode, the CPU 301 sets the frequency that is predetermined as the charging bias frequency to be the central frequency (S503), and sets a frequency change amount for performing the frequency change with a constant range from the central frequency (S504). The CPU 301 sets a time interval to perform the frequency change (S505), and calculates and sets the charging bias frequency to be output at every time interval of the frequency change (S506).

Next, the CPU 301 multiplies the calculated charging bias frequency by a constant indicating a frequency ratio with the developing bias frequency so as to calculate and set the developing bias frequency (S507). The CPU 301 outputs a drive clock for driving a high voltage transformer according to each set frequency. The high voltages are output according to the drive clock from the charging bias power supply and the developing bias power supply, so that the high voltages are supplied to the charger and the developing device (S508).

Then, the CPU 301 decides whether or not the image formation is finished (S509). If the image formation is finished, the CPU 301 finishes the image formation (S510). If the image formation is not finished, the CPU 301 resets the charging bias frequency (S506), sets the developing bias frequency according to the reset charging bias frequency (S507), and outputs the high voltage (S508).

In order to prevent the generation of interference fringes, it is necessary to control the developing bias frequency, which is applied at the position where the developing device 4 contacts with the photosensitive drum 2, to be an integral multiple of the charging bias frequency, which is applied at the same contact position on the photosensitive drum 2.

As illustrated in FIG. 3, the primary charger 3 and the developing device 4 are apart from each other to have different positional relationships in contacting with the photosensitive drum 2. As described above, the CPU 301 changes the charging bias frequency at a short time interval. Therefore, the charging bias frequency applied at the position where primary charger 3 contacts with the photosensitive drum 2 is different from the charging bias frequency when the contact position on the photosensitive drum 2 moves to the contact position with the developing device 4. Therefore, if the charging bias frequency and the developing bias frequency are changed at the same time, the above-mentioned two frequencies do not have a relationship of an integral multiple at the position where the developing device 4 contacts with the photosensitive drum 2 because of the different relationships of the contact positions on the photosensitive drum 2. As a result, interference fringes are generated.

Therefore, a contact time difference (contact time shift) between the primary charger 3 and the developing device 4 with respect to the photosensitive drum 2 is calculated from a distance between the contact positions of the primary charger 3 and the developing device 4 on the photosensitive drum 2 and a circumferential speed of the photosensitive drum 2. Further, the calculated contact time difference is taken into account in the timing of performing the frequency change of the charging bias and the developing bias, so that the problem of occurrence of interference fringes is solved. In other words, in the high voltage output process (S508) illustrated in FIG. 1, the CPU 301 first changes the charging bias frequency and controls the charging bias power supply and the developing bias power supply so as to change the developing bias frequency after the contact time calculated as described above passes. Thus, at the contact position between the developing device 4 and the photosensitive drum 2, the charging bias frequency and the developing bias frequency can maintain the frequency ratio of integral multiple, so that the occurrence of interference fringes can be prevented.

As described above, the charging bias frequency is changed periodically during the image formation. Thus, sound pressure of uncomfortable charging sound can be reduced. At the same time, the developing bias frequency is maintained to be an integral multiple of the charging bias frequency, so that occurrence of interference fringes can be prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-208012, filed Sep. 9, 2009, which is hereby incorporated by reference herein in its entirety.

What is claimed is:

1. An image forming apparatus comprising:

a charging unit which charges a surface of an image bearing member by contacting the image bearing member with a charging member to which a charging bias is applied, the charging bias being a voltage obtained by superimposing an alternative current voltage on a direct current voltage;

an electrostatic latent image forming unit which forms an electrostatic latent image on the surface of the image bearing member which is charged by the charging unit;

a developing unit which develops the electrostatic latent image by using a developing bias formed by the voltage obtained by superimposing the alternative current voltage on the direct current voltage; and a control unit which performs changing control of an alternative current frequency of the charging bias while maintaining a frequency ratio of an alternative current frequency of the developing bias to be an integral multiple of the alternative current frequency of the charging bias, wherein the control unit is configured to change the alternative current frequency of the charging bias within a predetermined range from a predetermined central frequency in the changing control of the alternative current frequency of the charging bias.

2. An image forming apparatus according to claim 1, wherein the alternative current frequency of the developing bias, which is applied at a contact position between the image bearing member and the developing unit, is an integral multiple of the alternative current frequency of the charging bias applied at the contact position.

3. An image forming apparatus comprising:

a charging unit which charges a surface of an image bearing member by contacting the image bearing member with a charging member to which a charging bias is applied, the charging bias being a voltage obtained by superimposing an alternative current voltage on a direct current voltage;

an electrostatic latent image forming unit which forms an electrostatic latent image on the surface of the image bearing member which is charged by the charging unit;

a developing unit which develops the electrostatic latent image by using a developing bias formed by the voltage obtained by superimposing the alternative current voltage on the direct current voltage; and a control unit which performs changing control of an alternative current frequency of the charging bias while maintaining a frequency ratio of an alternative current frequency of the developing bias to be an integral multiple of the alternative current frequency of the charging bias, wherein in the changing control of the alternative current frequency of the charging bias, the control unit determines a frequency change amount from a central frequency that is predetermined as the alternative current frequency of the charging bias, and a time interval for changing the alternative current frequency, and changes the alternative current frequency of the charging bias within a range of the frequency change amount from the central frequency at the time interval during image formation.

* * * * *